US012600561B2

(12) United States Patent
Sleeman

(10) Patent No.: US 12,600,561 B2
(45) Date of Patent: Apr. 14, 2026

(54) FLUID STORAGE TANK INCLUDING A FLEXIBLE BLADDER SUPPORTED ON A COLLAPSIBLE RIGID FRAME

(71) Applicant: Marlea Sleeman, Edmonton (CA)

(72) Inventor: Marlea Sleeman, Edmonton (CA)

( * ) Notice: Subject to any disclaimer, the term of this patent is extended or adjusted under 35 U.S.C. 154(b) by 66 days.

(21) Appl. No.: 17/799,476

(22) PCT Filed: Feb. 24, 2021

(86) PCT No.: PCT/CA2021/050219

§ 371 (c)(1),
(2) Date: Aug. 12, 2022

(87) PCT Pub. No.: WO2021/168562

PCT Pub. Date: Sep. 2, 2021

(65) Prior Publication Data

US 2023/0097613 A1 Mar. 30, 2023

Related U.S. Application Data

(60) Provisional application No. 62/980,525, filed on Feb. 24, 2020.

(51) Int. Cl.

| | |
|---|---|
| ***B65D 90/20*** | (2006.01) |
| ***B65D 88/74*** | (2006.01) |
| ***B65D 90/00*** | (2006.01) |

(52) U.S. Cl.

CPC ..... *B65D 90/205* (2013.01); *B65D 88/744* (2013.01); *B65D 90/0033* (2013.01)

(58) Field of Classification Search

CPC ..... B65D 90/205; B65D 88/744; B65D 90/0033; B65D 90/12; B65D 33/00–38; B65D 57/00; B65D 61/00; B65D 90/20; B65D 90/14

See application file for complete search history.

(56) References Cited

U.S. PATENT DOCUMENTS 2,391,374 A * 12/1945 Wickstrum ..... B65D 90/20 52/63
2,749,956 A * 6/1956 Giles ..... B65D 88/522 220/9.3
4,281,813 A * 8/1981 Garrity ..... B65B 67/1205 220/9.4

(Continued)

*Primary Examiner* — Kareen K Thomas
(74) *Attorney, Agent, or Firm* — Ryan W. Dupuis; Kyle R. Satterthwaite; Ade & Company Inc.

(57) ABSTRACT

A fluid storage tank has a base structure, perimeter columns extending upward from the base structure and a flexible bladder contained within the perimeter columns to define a boundary of the tank. The base structure is arranged to be supported on a supporting foundation to span a bottom of the tank. The upright columns are releasably coupled to the base structure and extend upward at circumferentially spaced apart positions about a perimeter of the tank in a working position of the columns. The upright columns are collapsible from the working position to a transport position in which the columns are arranged to be bundled alongside one another. The flexible bladder is coupled to the upright columns and contains a fluid within the tank in the working position while being collapsible within the columns into the transport position.

40 Claims, 9 Drawing Sheets

(56) References Cited

U.S. PATENT DOCUMENTS 4,356,933 A * 11/1982 Connolly ..... E04H 4/0056 220/495.1
4,640,328 A * 2/1987 Arney ..... B65D 88/16 248/431
5,009,189 A * 4/1991 Neff ..... A01K 61/60 119/239
5,316,175 A * 5/1994 Van Romer ..... F16N 31/006 220/4.12
6,098,744 A 8/2000 Kawamura
6,152,707 A 11/2000 Alberg
6,287,003 B1 * 9/2001 Hafer ..... B65D 88/1631 220/9.1
7,036,676 B2 * 5/2006 Christensen ..... E04H 4/0056 220/666
7,717,296 B1 * 5/2010 Guthrie ..... B65D 90/00 222/105
8,100,614 B2 1/2012 Jerich
8,191,723 B2 * 6/2012 Donaldson ..... B65D 88/08 220/9.4
8,733,579 B2 5/2014 Claeys
8,746,478 B2 6/2014 Claeys
8,894,282 B2 * 11/2014 Town ..... B65D 88/1625 383/17
9,193,501 B1 11/2015 Christensen
9,296,556 B2 * 3/2016 Townsend ..... B65D 90/0033
9,403,640 B1 8/2016 Crain
9,586,753 B2 3/2017 Hanson et al.
9,957,104 B2 5/2018 Hindbo
10,287,092 B2 5/2019 Daubert et al.
10,370,185 B2 8/2019 Hindbo
2003/0024203 A1 * 2/2003 Kuo ..... G09F 15/0068 52/646
2010/0320203 A1 * 12/2010 Moodie ..... E03B 3/03 220/9.3
2011/0276780 A1 11/2011 Sengupta et al.
2014/0301669 A1 * 10/2014 Baeck ..... B65D 88/24 53/469

* cited by examiner

FLUID STORAGE TANK INCLUDING A FLEXIBLE BLADDER SUPPORTED ON A COLLAPSIBLE RIGID FRAME

FIELD OF THE INVENTION

The present invention relates to a fluid storage tank including a flexible bladder for containing a stored fluid therein and a rigid frame supporting the bladder in a working position, in which the rigid frame and the flexible bladder are collapsible together from the working position to a transport position.

BACKGROUND

In the field of hydrocarbon production, hydraulic fracturing is a well-known process for stimulating production of hydrocarbons in a wellbore in which rock is fractured by high-pressure injection of a fracking fluid into the wellbore. The fracking fluid is primarily water which are blended with sand or other proppants suspended within the fluid. As hydraulic fracturing operations are commonly performed at remote wellbore locations which can be far from a suitable source of water, large water storage facilities are required on site or near the wellsite to meet the demands for water. A common structure for a water storage at a wellbore site includes use of a ring dyke with a liner therein to form a tank structure capable of containing large volumes of water. This type of structure is very labor intensive to set up and later disassemble for transport to another wellbore site when the hydraulic fracturing operation is complete, and typically stores a low volume per square foot within its footprint. In other instances, smaller portable tanks are provided which can be quickly set up, but these readily portable tanks typically have a limited storage capacity. Lastly, excavated ponds with or without liners may additionally be utilized, however, may not be desirable due to regulatory processes, inability to secure adequate space for the pond, increased disturbance footprint, geotechnical or hydrogeological challenges, or challenges preserving water quality in the pond.

There are many other environments and industrial processes that could benefit from the development of a portable tank structure that is easy to set up with low skilled labor, and that has an ability to store very large volumes of water once assembled.

SUMMARY OF THE INVENTION

According to one aspect of the invention there is provided a fluid storage tank comprising:

- a base structure arranged to be supported on a supporting foundation to span a bottom of the tank;
- a plurality of upright columns arranged to be coupled to the base structure and to extend upwardly from the base structure at circumferentially spaced apart positions about a perimeter of the tank in a working position of the columns;
- a flexible bladder arranged to be coupled to the upright columns so as to define a bottom boundary and an upright perimeter boundary of the tank suitable for containing a fluid within the tank;
- the upright columns being collapsible from the working position to a transport position in which the columns are arranged to be bundled alongside one another.

The invention generally relates to a collapsible fluid storage system, typically intended for short term installations for which frequent relocation is desirable.

The user may use this for frac water storage, either as the primary storage compartment, or to have interim "surge" storage which would permit the user to withdraw water from sources, such as ponds, and hold enough water for one or more stages onsite to ensure that frac stages will not be interrupted due to failures in pumping equipment or infrastructure, and in order to heat the water or prevent the water from freezing if required. The water may be fully heated in this storage, or the water could instead be just kept warm enough in immediate proximity that the line heater beyond the discharge of the water storage would instead heat the water after discharge.

Having "surge" storage volumes enables crews to plan frac stages with surety that they will have enough water without being subject to any failure from the water source. The water would be trucked or pumped from the remote distances, thus once there is enough in this storage, they would be able to begin a frac.

In other uses, there could be other liquids stored, but the primary interest would be where water is required for temporary measures, such as: camp facilities, temporary ready mix concrete plant setups, events/festivals, disaster relief work and similar type uses. Other uses of the storage tank include chemical storage for hydraulic fracturing sites, potable water storage for remote temporary uses, temporary storage of water or fluids for treatment, and the like.

The bladder may be arranged to remain coupled to the upright columns as the columns are collapsed from the working position to the transport position.

Each of the columns may extend a full height of the storage tank and remain fixed in length as it is displaced between the working position and the transport position.

The storage tank may further include strapping members arranged to extend under tension circumferentially about the upright columns bundled in the transport position such that the columns are supported in fixed relation to one another by the strapping members in the transport position.

Preferably at least some of the columns includes rigging mounts formed thereon so as to be arranged to secure the columns to a crane lift cable. A lifting harness may be further provided comprising (i) a central lifting attachment for connection to the crane lift cable and (ii) a plurality of intermediate cables for connection between the central lifting attachment and the riggings mounts of the columns respectively.

Preferably a plurality of tension members are coupled between the upright columns in a circumferential direction of the tank in the working position in which the tension members are flexible so as to remain coupled between the upright columns as the columns are collapsed from the working position to the transport position. The tension members may include flexible cables extending about a full circumference of the tank in the working position. The tension members may also include structural straps extending about a full circumference of the tank in the working position.

The storage tank preferably also includes a plurality of upper supports connected between the upright columns to span over a top of the flexible bladder in the working position above the bladder. The upper supports are preferably flexible and remain coupled to the columns so as to be collapsible together with the columns between the working position and the transport position.

The base structure may include a plurality of flexible members extending diametrically under tension across the bottom of the tank between respective ones of the upright columns below the bladder.

The base structure may include a plurality of rigid panels releasably connected with one another to form a floor supporting the upright columns and the flexible bladder thereon.

The rigid panels preferably include sockets supported thereon and arranged to receive respective ones of the columns therein in the working position. The sockets may be recessed into the panels or may be formed in sleeves that are releasably mounted to protrude upward from the panels.

Preferably the columns are releasably attached to the base structure and the base structure and the columns include corresponding identification markings formed thereon.

The tank may further include a plurality of brace members releasably connected between an exterior of the columns and the base structure at a location spaced outwardly from the bladder in the working position.

A plurality of guy wires may be releasably connected between the columns and the base structure at a location spaced outwardly from the bladder in the working position.

The bladder may comprise a bag which fully encloses a hollow interior of the bladder for containing the fluid thereon.

Preferably the bladder is arranged to be folded inwardly upon itself together with movement of the columns inwardly towards one another from the working position to the transport position thereof.

A plurality of tension members may be coupled between the upright columns in a circumferential direction of the tank in the working position in which the bladder is connected to the tension members.

The bladder may be pressurized with air. In this instance, a blower may be operatively connected to the bladder so as to be arranged to inflate the bladder and drive expansion of the columns from the transport position to the working position. A blower may also be provided with a controller arranged to monitor air pressure within the bladder and activate the blower to maintain pressure above a prescribed lower limit. A relief valve is preferably arranged to relieve air from the bladder when air pressure within the bladder exceeds a prescribed upper limit.

An outer boundary of the bladder may be insulated by various means including use of a perimeter boundary compartment filled with air or another liquid, or use of a blanket of heat insulating material surrounding some or all of the outer boundary.

The bladder may comprise a plurality of compartments separated by flexible partition walls within an outer boundary of the bladder.

A plurality of flexible support members may be connected between the partition walls and the outer boundary of the tank to support the partition walls relative to the outer boundary of the bladder.

The compartments may include an inner compartment and an outer compartment surrounding at least one of a top and a perimeter of the inner compartment. The outer compartment may be filled with a heat insulating fluid, with air, or with a heated fluid. Contents of the outer compartment may be recirculated using a blower or a pump.

A heater may be further provided for heating contents of the bladder. The heater may comprise an electrical heater. The heater may comprise a heat exchanger fluid circulated within a respective heat exchanger passage extending between a combustion heater and the bladder. The heater may comprise a heat exchanger fluid circulated within a respective heat exchanger passage extending between an external source of waste heat and the bladder. The heater may directly heat stored liquid within the bladder.

When the bladder has an inner compartment receiving stored fluid therein and an outer compartment surrounding a top and a perimeter of the inner compartment which receives an insulating fluid therein, the heater may be arranged to heat the insulating fluid in the outer compartment.

Alternatively, the heater may be provided at an outer boundary of the bladder for heating stored liquid in the bladder, or at the bottom boundary of the bladder.

When the base structure includes a plurality of rigid panels releasably connected with one another to form a floor supporting the upright columns and the flexible bladder thereon, the heater may be incorporated into the rigid panels.

When at the bottom boundary, the heater may be received between the base structure and the bottom boundary of the tank.

Alternatively, the heater may be provided at the upright perimeter boundary of the bladder.

The storage tank may further include a recirculating pump in operative connection with the bladder so as to be arranged to recirculate stored fluid in the bladder.

The storage tank may be provided with both a primary pump arranged to deliver stored fluid from the bladder and a secondary pump operatively connected in redundant relationship to the primary pump, in which a controller is arranged to automatically activate the secondary pump in response to detection of a fault of the primary pump.

When a pump is arranged to deliver stored fluid from the bladder, an inline heater may be connected inline with the pump so as to be arranged to heat the stored fluid as the stored fluid is delivered from the bladder. The storage tank may further include a secondary heater operatively connected in redundant relationship to said inline heater, and a controller arranged to automatically activate the secondary heater in response to detection of a fault of the inline heater.

The storage tank may be used in combination with a hydraulic fracturing arrangement in which the flexible bladder stores water therein for use by the hydraulic fracturing arrangement.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
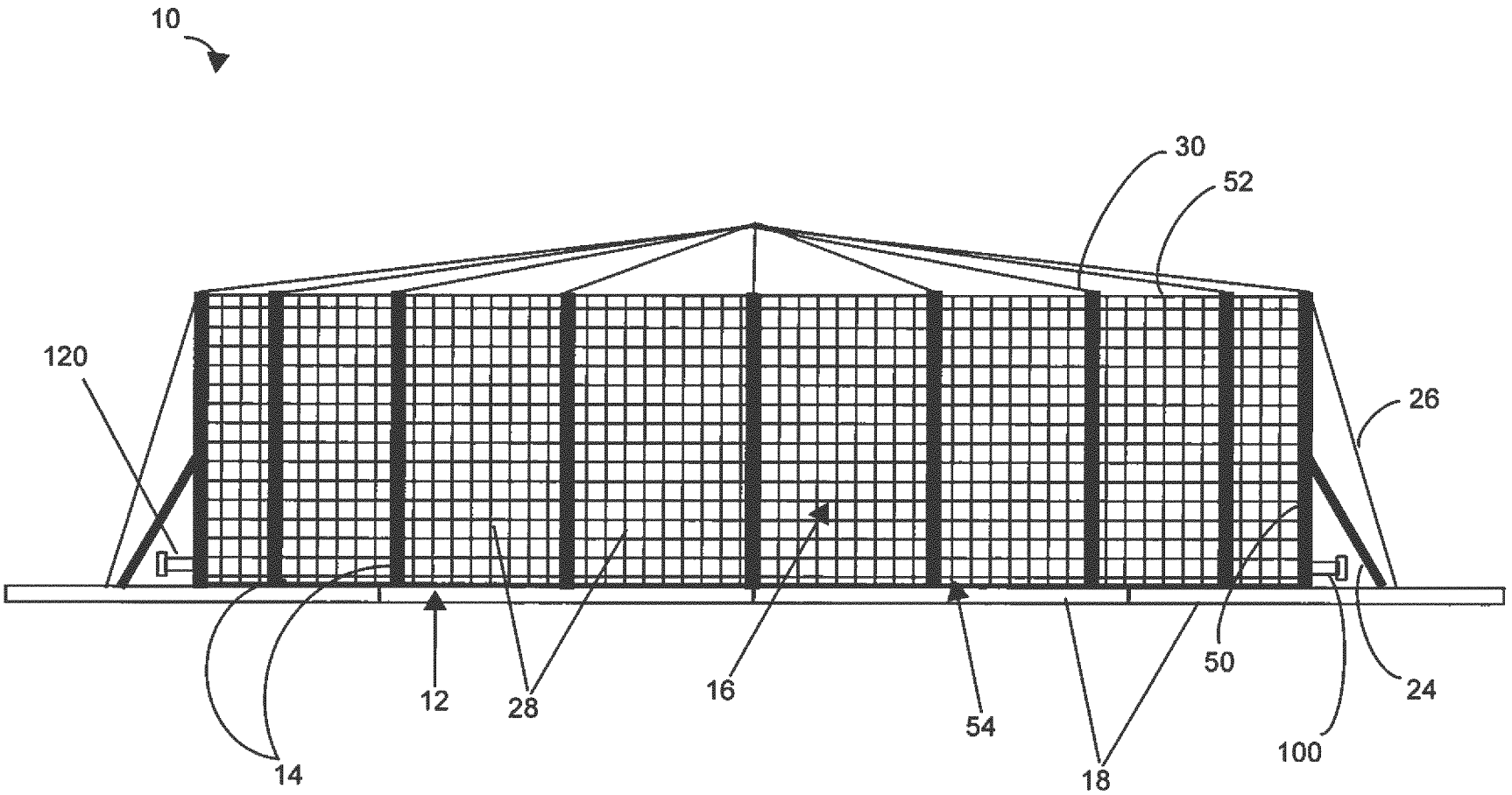
FIG. 1 is a side elevational view of a first embodiment of the fluid storage tank in a working position.
Figure 2:
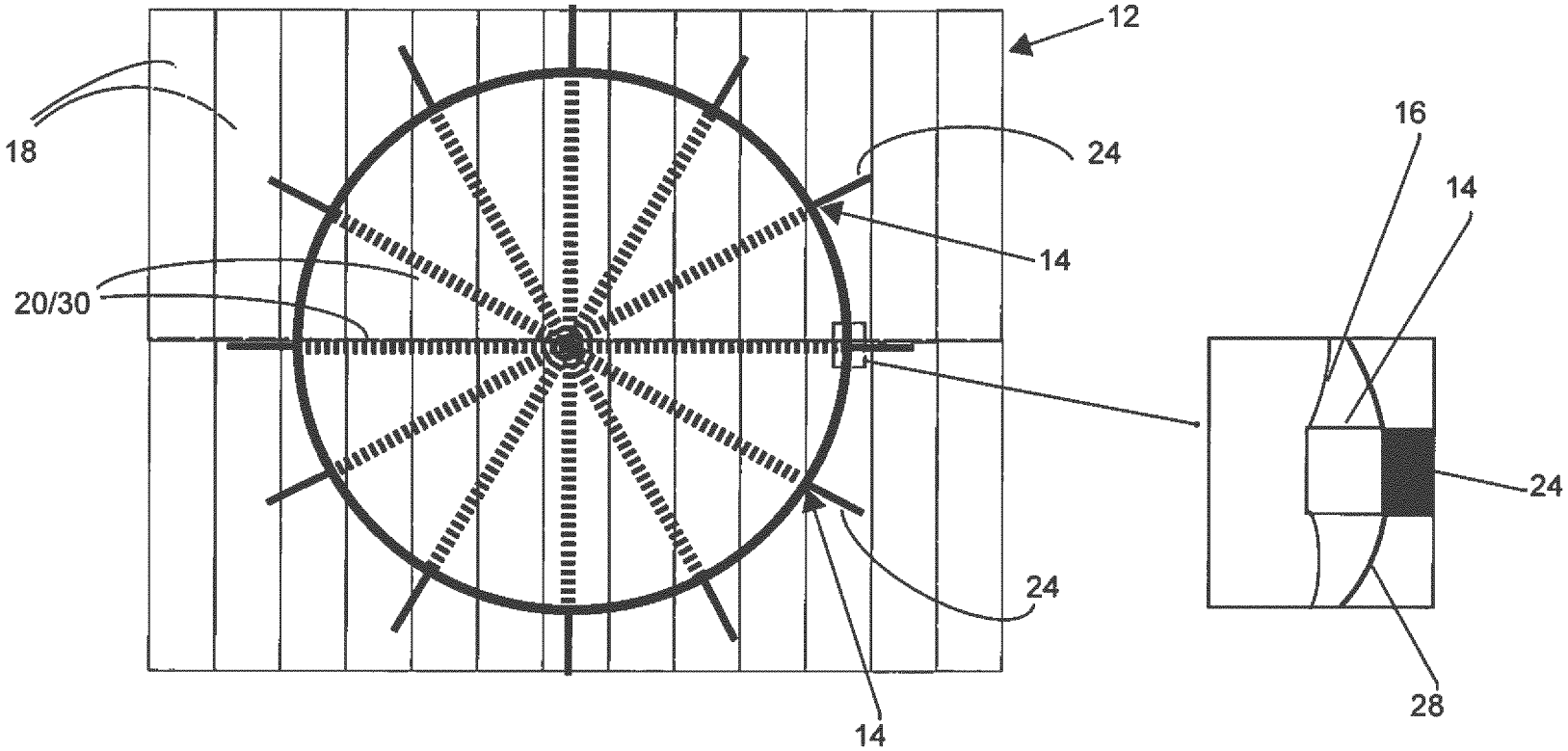
FIG. 2 is a top plan view of the storage tank according to FIG. 1.

Referring to the accompanying figures, there is illustrated a fluid storage tank generally indicated by reference numeral 10. The storage tank 10 generally includes (i) a base structure 12 for being supported on a suitable foundation, (ii) a collapsible frame comprised of perimeter columns 14 spanning a height of the tank at circumferentially spaced positions about a perimeter of the tank, and (iii) a bladder 16 which is supported by the collapsible frame so that the hollow interior of the bladder defines a storage volume therein capable of retaining fluids therein, whether in a liquid or gaseous state. The base structure 12 is arranged to span the bottom of the bladder and is intended to be supported on a suitable foundation such as a sand or gravel base or other suitably compacted ground and the like. In the illustrated embodiment, the base structure 12 is defined by a mat assembled from a plurality of rigid panels 18 interconnected side-by-side with one another in rows and interconnected end to end with one another in columns within a generally common plane. The rigid panels collectively define an upper supporting surface by the interconnected flat rigid top plates of the individual panels 18.

Each individual rigid panel 18 further includes a plurality of beams spanning the length of the panel with interconnecting crossbars between the beams to define a rigid structural frame of the panel that supports the top plate of the panel thereon when the bottom of the panel is engaged upon the ground. Suitable connectors are provided at the perimeter edges of each panel which are arranged for mating connection with the corresponding connectors of adjacent panels using pins or bolts and the like for example. Each panel edge is connected to the corresponding edge of an adjacent panel at spaced apart locations to form a rigid connection between the panels resulting in all of the panels collectively forming a single rigid mat capable of supporting the tank on the top side thereof. The panels are assembled to define a mat having dimensions which are greater than the width and length of the bladder in a deployed working position thereof so as to protrude laterally outwardly beyond the bladder in all directions.

The base structure 12 provides a structural connection between the columns 14 of the collapsible frame which are spaced apart about the perimeter of the tank. In particular, the base structure provides strength under tension between diametrically opposed ones of the columns to prevent lateral spreading of the columns apart from one another.

In further embodiments, the base structure 12 may include flexible members 20 connected under tension diametrically across the tank between opposing columns to further resist radially outward forces acting on the columns from the bladder when the bladder is contained within the collapsible frame of columns and is filled with fluid that applies outward pressure onto the columns. The flexible tension members 20 of the base structure may comprise individual flexible cables or straps connected between respective pairs of the columns, or a flexible mesh or grid of straps forming a sheet fully spanning the bottom side of the bladder in connection with all of the columns.

The rigid collapsible tank frame is primarily defined by the columns 14. In either the working or transport positions of the tank, each column is a rigid post of fixed length that spans substantially the full height of the tank. In the working position, the columns are circumferentially spaced apart about the full perimeter of the tank. The columns are rigidly connected in fixed relation to the base structure in the working position. When collapsing the frame into the transport position, the columns are released from the base structure to enable the columns to be displaced generally radially inward towards one another to form a bundle in which the columns extend parallel to one another generally alongside one another so as to occupy a minimum footprint compared to the working position.

Figure 5:
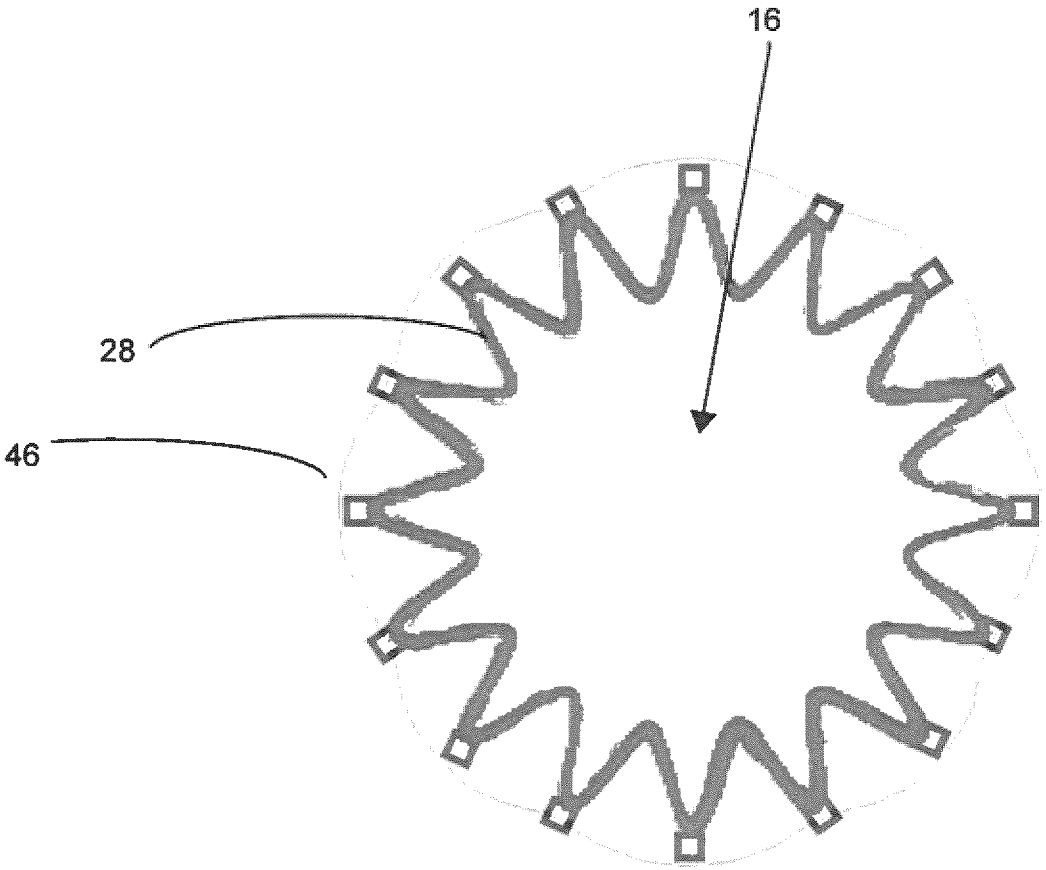
FIG. 5 is a top plan view of the storage tank according to FIG. 1 shown in the transport position.
Figure 6:
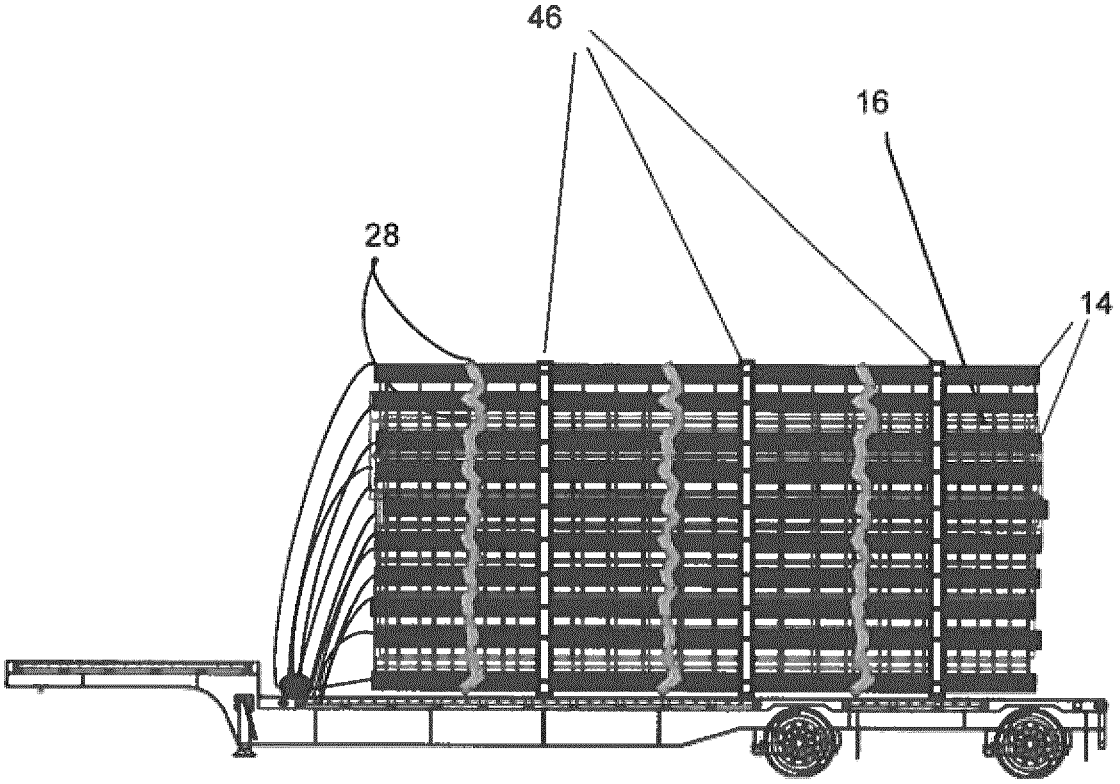
FIG. 6 is a side elevational view of the storage tank collapsed in the transport position and supported on a deck trailer for transport.
Figure 7:
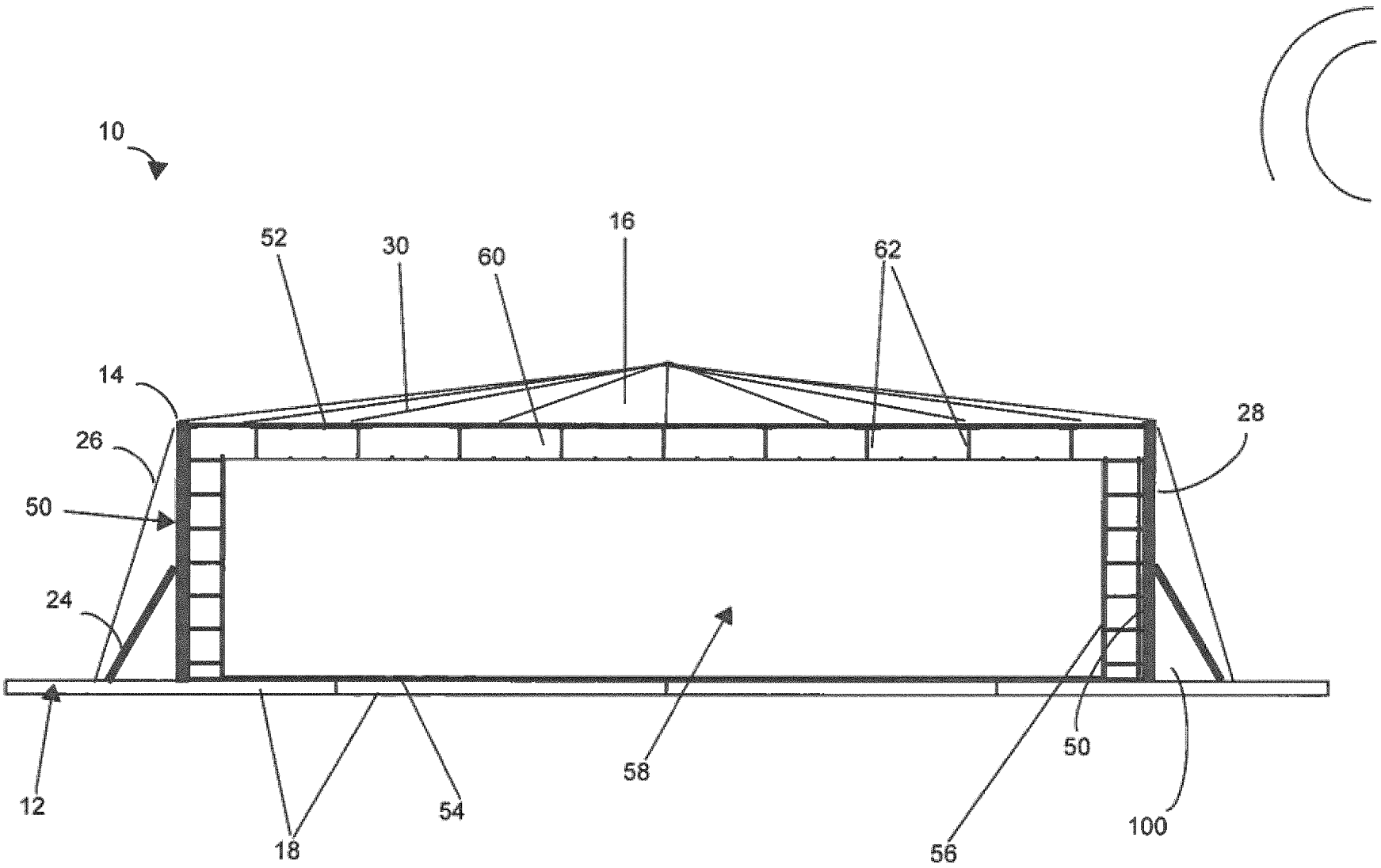
FIG. 7 is a side elevational view of a second embodiment of the fluid storage tank in a working position.
Figure 8:
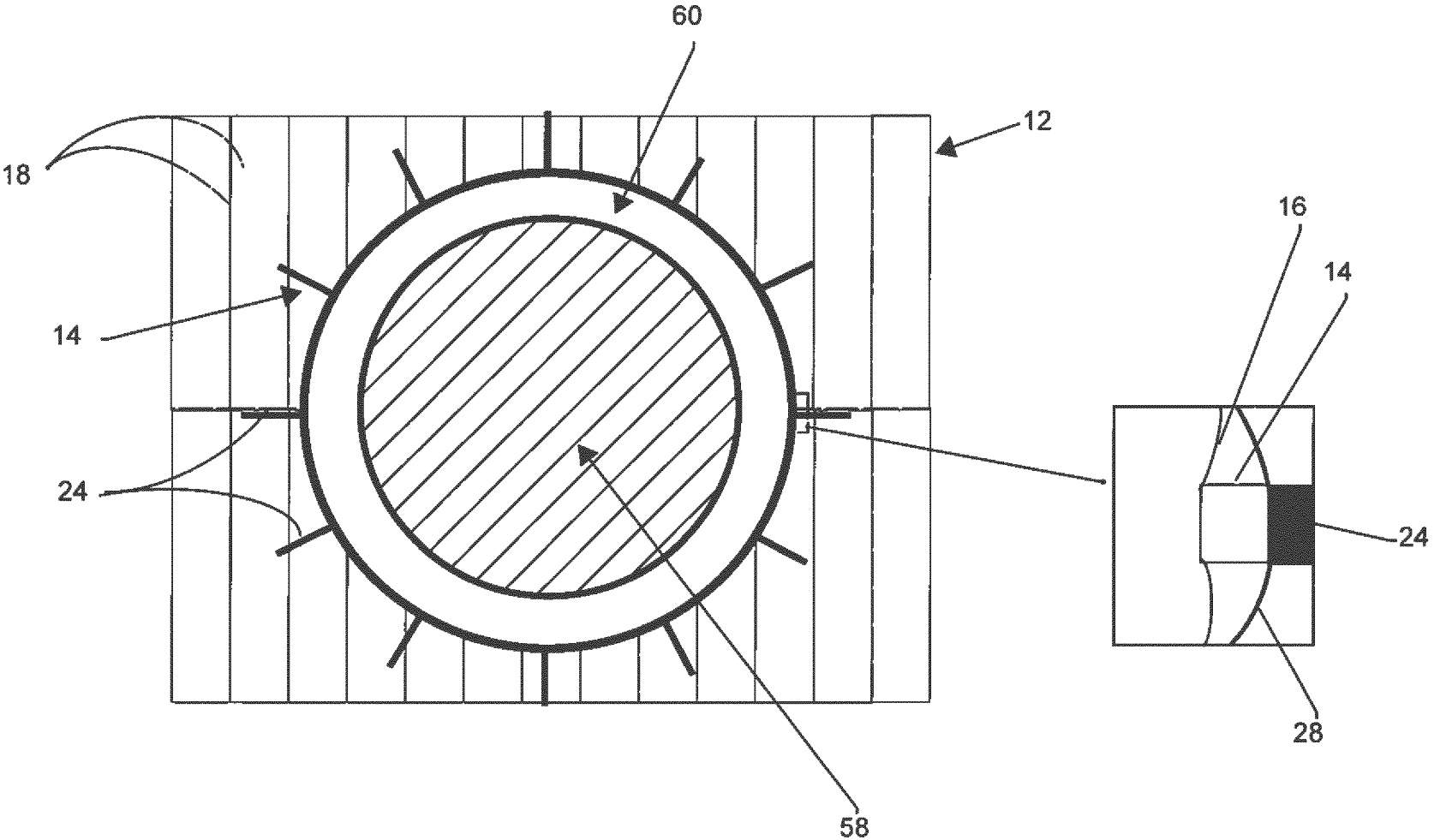
FIG. 8 is a top plan view of the storage tank according to FIG. 7.

The bladder 16 is supported on the columns so as to typically remain coupled to the columns as the columns are displaced between the transport and working positions thereof. As the columns are displaced towards the transport position, the flexible envelope material forming the boundary of the bladder is folded inwardly upon itself as shown in FIG. 5 such that the bladder generally remains within a perimeter boundary defined by the columns that remain spaced apart circumferentially about the bladder as the bladder is collapsed.

In the working position, each frame column 14 has a bottom end which is received within a socket 22 formed in or on the rigid panels 18 of the base structure such that the bottom end of the column is inserted into the socket in recessed relation to the upper supporting surface of the base structure when mounted in the working position. A plurality of sockets may be formed in recessed relation within each panel to support the columns adjustably at different locations within the panels if the panels are intended to be interchangeable with one another.

Alternatively, the sockets 22 may be defined within respective mounting sleeves that are mountable on the panels 18 above the upper supporting surface of the panels 18 at any one of a plurality of mounting locations on the panels. For example, each panel may include a plurality of mounting locations defined by fastener apertures or mounts of various configurations onto which the sleeve may be releasably attached in fixed relation to the panel. The sleeves are oriented to extended perpendicularly upwardly from the upper supporting surface of the panels in a mounted position so that the socket therein releasably receives the respective column through the open top end of the sleeve in use.

Suitable fasteners rigidly connect the bottom end of the column 14 to the sockets on the rigid panels such that the column is fixed in perpendicular relation extending upwardly from the respective rigid panel to which it is coupled by the interlocking connection of the columns with the sockets. Suitable identification markings are provided on each column and on each corresponding rigid panel in addition to identification markings on adjacent rigid panels to assist users in properly assembling the panels to the proper designated panels with which they are intended to be coupled and to assist users in properly connecting the columns to the proper designated sockets within the panels.

Each column is further secured to the rigid panels of the base structure using a respective angled brace member 24 which is coupled at an intermediate height along the column at a top end of the brace member and coupled to a respective socket within the rigid panels of the base structure at a bottom end of the brace member which is spaced radially outward from the corresponding column. Opposing ends of the brace member are connected to the column and the rigid panels of the base structure using suitable releasable fasteners and the like to allow disassembly. The angled brace members 24 are typically connected between the columns and the base structure subsequent to attachment of the columns but prior to filling of the bladder with fluid. Auxiliary fasteners in addition to the angled brace members 24 may be used on the rigid panels 18 to strengthen interconnection between the same and the columns.

Additional tension members such as guy wires 26 can be connected between (i) the top ends of the columns respectively at locations spaced above the top end of the angled brace murmurs 24 and (ii) the bottom ends of the angled brace members 24 at a location spaced outwardly from the columns respectively such that the tensioning of the guy wires resist inward displacement of the columns prior to filling with fluid.

The collapsible frame of the tank further includes a plurality of circumferential tension members 28 which extend about the full circumference of the tank at a plurality of different elevations. The tension members 28 are each formed in sections in which each section spans between an adjacent pair of the columns to which the tension members are coupled. The tension members can comprise flexible straps or cables and the like extending about the full circumference of the tank at a respective elevation so as to provide hoop strength to the bladder received within the interior of the columns connected by the tension members. The tension members may be coupled to either the inner side or the outer side of the columns.

In further embodiments the tension members 28 may comprise a grid of straps forming an interconnected mesh or a continuous fabric sheet having considerable tensile strength compared to the bladder for being connected in the circumferential direction between adjacent columns along the full height thereof to form a structural boundary for containing the bladder inside the perimeter boundary defined by the columns at the intermediate locations between the columns.

Preferably, the tension members 28 are a combination of cables or straps extending about the full circumference of the tank at the outer side of the columns to contain the columns inwardly of the cables or straps, together with a continuous sheet or net of cables/straps that spans about the circumference of the bladder across the full height of the bladder at an inner side of the columns and outer circumferential cables and straps.

The interconnected cables or straps that form a grid or sheet-like assembly are preferably fixed to the columns 14 while being flexible and collapsible with the columns from the working position to the collapsed position. When provided at the interior side of the columns, the grid or cables or straps provide hoop strength and circumferential support directly about the circumference of the flexible bladder. The tension members 28 in this instance are preferably also connected to the bladder in fixed relation to one another at a plurality of connecting locations respectively.

In the instance of tension members 28 such as cables or straps extending about a circumference of the columns, the cables in this instance may be coupled to the columns at the exterior of the columns to provide additional circumferential support directly to the columns. The connection of circumferential cables or straps to the columns may be accomplished by passing or threading the tension members 28 through anchor loops at fixed locations on the exterior of the columns. This allows the tension members 28 to be cinched about the columns to assist in collapsing the columns if desired, as described in further detail below.

Once the tank has been assembled and a bladder filled with stored fluids in liquid and/or gaseous states is received within the assembled frame, the outward pressure of stored fluids within the bladder acting on the columns are contained by the circumferential tension members 28. The tension members 28 remain flexible and foldable so as to be collapsed inwardly upon themselves together with the collapsing of the bladder 16 from the working position to the transport position so that the tension members 28 remain coupled to the columns 14 in both positions.

The collapsible frame further includes a plurality of upper supports 30 spanning over the top of the bladder 16 between the top ends of the columns 14. The upper supports 30 comprise flexible tension members which may include individual straps or cables extending radially or diametrically between a respective diametrically opposed pair of columns 14. In other instances, the upper supports 30 are connected with one another to form a mesh, net or grid structure functioning as a continuous sheet under tension across the top of the bladder between opposed columns so as to resist outward spreading of the columns relative to one another when the columns are under pressure from fluid contained within a bladder within the interior of the perimeter defined by the columns, thus preserving the shape and structural integrity of the storage system. In either instance, the upper supports 30 span over a top of the flexible bladder and extend across a diameter of the tank in the working position.

All of the columns 14 further include a plurality of rigging mounts 32 formed thereon at spaced apart positions along the columns and at the top ends of the columns to readily enable various cable attachments of a lifting harness thereto. The lifting harness 34 comprises an arrangement of lifting cables used for supporting the columns relative to one another once they are detached from the base structure as they are collapsed inwardly towards the transport position, or for supporting the columns as they are spread outwardly from the transport position towards the working position prior to attachment to the base structure.

The lifting harness includes a central lifting attachment 36 which is arranged to be releasably coupled to the main lift cable of a crane. A plurality of intermediate cables 38 extend generally radially outward from the central lifting attachment 36 to respective ones of the rigging mounts 32 on some or all of the columns 14 so that some or all columns are connected to the lifting harness.

Optionally, a plurality of transverse members 40 may be interconnected in the circumferential direction between adjacent ones of the intermediate cables 38 of the lifting harness to support the intermediate cables at a prescribed spacing about the circumference of the tank in either of the transport or working positions. The lifting harness may also include a plurality of auxiliary cables 42 which are connected to intermediate locations along the upper boundary of the bladder at a location spaced inwardly of the columns to assist in managing the excess bladder material as the columns are displaced inwardly towards the transport position. One or more internal cables 44 may be further interconnected through the hollow interior of the bladder between the top and bottom boundary walls thereof to lift the bottom panel of the bladder upwardly within the perimeter boundary defined by the columns as the tank is collapsed towards the transport position. The additional cables 42 and 44 thus assist in guiding the material of the bladder to fold inwardly upon itself as the tank is collapsed.

In this manner, when it is desired to collapse the tank, an operator initially connects the lifting harness 34 to each of the columns and to other attachment locations on the bladder. Once the lifting harness has been partially lifted to partially support the weight of the columns and the material of the bladder, the columns may be released from the base structure so that further upward lifting of the lifting harness will pull the columns radially inward towards one another while also gathering the bladder upwardly and inwardly upon itself within the perimeter boundary of the columns. By managing the inward folding of the bladder upon itself within the perimeter boundary of the columns, the bladder can remain connected to the columns while simultaneously maintaining connection of all of the tension members between the columns. Once the columns are positioned closely alongside one another in a bundle with the bladder being fully collapsed within the perimeter boundary of the collapsed columns, additional strapping members 46 can be secured about the circumference of the bundle at various elevations to fix the columns in relation to one another in the bundled transport position.

Figure 4:
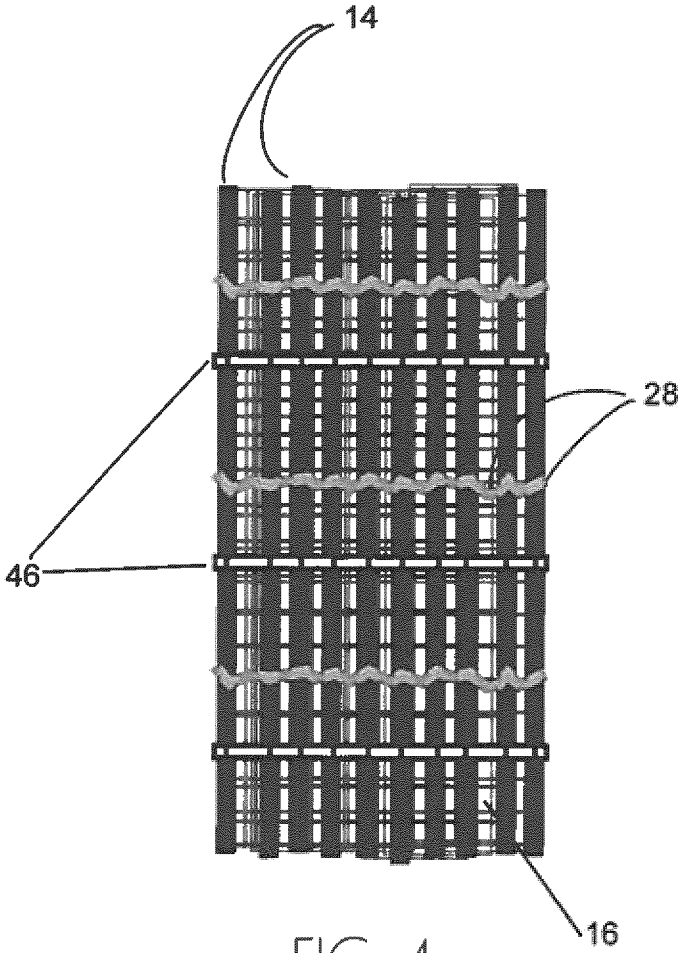
FIG. 4 is a side elevational view of the storage tank according to FIG. 1 secured in the transport position with strap members.
Figure 3:
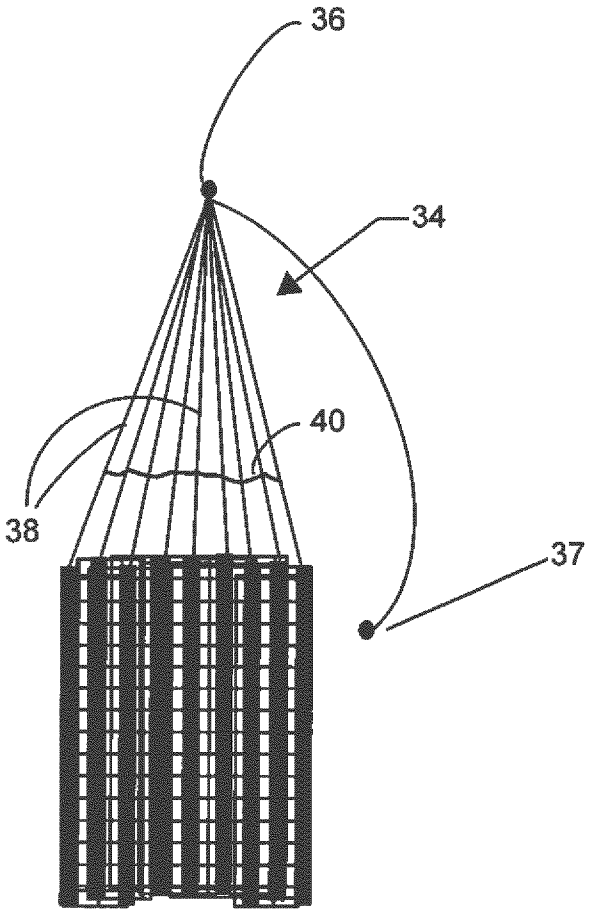
FIG. 3 is a side elevational view of the storage tank according to FIG. 1 being lifted into a transport position.

Alternatively, some of the tension members 28 that extend about the circumference of the tank and that are threaded through rigid anchor loops on the exterior of the columns 14, may be pulled outward at one side of the tank or otherwise shortened in circumference by a winch type mechanism for example, so that the remaining portion of the tension members extending about the columns are cinched about the columns, thereby assisting in collapsing the columns inwardly towards one another into the bundled configuration shown in FIG. 4. In this instance, the tension members 28 that are cinched about the columns can remain attached under tension in the bundled configuration of FIG. 4 to provide the function of the strapping members 46 without any additional strapping members 46 being required. Other tension members 28 extending about the circumference of the bundled columns may simply be gathered as the columns are collapsed.

In a further arrangement, the lifting harness 34 may remain attached to the columns in both the working and transport positions. A rigging extender 37, in the form of a long lead lift cable, may be connected to the central lifting attachment 36 in this instance. When in the working position, with the intermediate cables 38 of the lifting harness collapsed onto the top side of the tank, the rigging extender has sufficient length to reach from the central lifting attachment 36 at a top side of the tank to a secondary attachment at the free end of the rigging extender 37 opposite from the central lifting attachment 36 with the secondary attachment being located at one side of the tank close enough to the base structure or ground that a person can reach. In this manner, a lifting crane can be connected by an operator at ground level to the secondary attachment at the end of the rigging extender 37 for lifting into the collapsed position. When in the working position, the rigging extender 37 can remain stored in secure connection to one of the columns 14.

In further arrangements, the rigging mounts 32 can be located on the columns 14 at a location spaced below the top ends thereof, for example at a height reachable by an operator on the base structure at ground level. In this manner, the crane could rig up with a person walking around the circumference hooking up the cables, while the picker crane would be connected to the central lifting attachment 36 above the tank to suspend the intermediate cable 38 therefrom. This would avoid needing to have a manlift to hook up any rigging to either the central lifting attachment 36 (if the rigging was permanently attached), or to a variety of tall columns 14 where the rigging mounts are higher than a person can reach to rig.

The columns remain fixed in length so as to continue to span the full height of the tank as it is displaced from the working position to the transport position thereof. Once the strapping members have been secured about the bundle of columns with the bladder contained therein, a crane can be further used for laying the bundled columns onto a trailer such that the longitudinal direction of the columns is oriented along the lengthwise forward direction of the transport trailer. For example, the columns may have a height of approximately 40 feet in the working position resulting in a bundled frame in the transport position which is approximately 40 feet in length for spanning the length of a suitable flat deck trailer. The flat deck trailer is preferably equipped with suitable lateral containment defining lateral boundaries along each side of the deck to contain the collapsed tank therebetween. For example, suitable stakes or poles may be fixed at spaced positions along each side of the trailer deck to define the lateral boundaries and receive the bundled and collapsed tank between the lateral boundaries.

When it is desired to deploy the tank structure from the transport position to the working position thereof, a crane can be used for connection to the lifting harness 36 to initially suspend the collapsed frame and bladder of the tank above an assembled base structure. The strap members 46 can be released while the lifting harness continues to suspend the columns therefrom in near vertical orientation. Various means can be used to then spread the columns outwardly away from one another towards the transport position.

Figure 9:
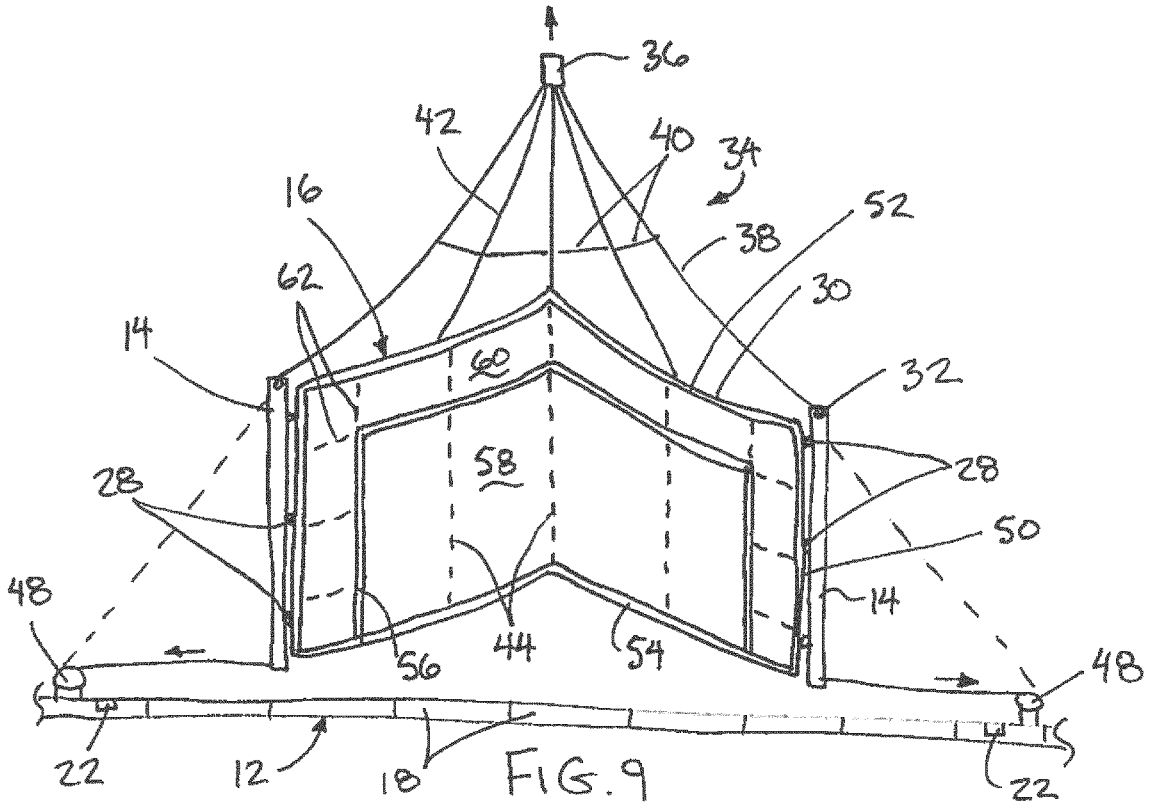
FIG. 9 is a schematic representation of the storage tank at an intermediate stage of deployment between the storage and transport positions.

In one example, as shown in FIG. 9, a plurality of winches 48 can be affixed to the upper supporting service of the base structure with respective winch cables coupled to respective ones of the columns. Operating the winches to wind the winch cables onto the winch assemblies acts to pull the columns radially outward relative to other columns towards the respective designated mounting location on the base structure. The columns may initially be pivotally connected to the respective socket mounting locations on the base structure at the bottom end thereof with the columns extending inwardly towards one another to the top ends thereof. Additional winches can then be used in connection to the top ends of the columns to raise the columns outwardly into a vertical orientation relative to the base structure whereupon further fastener connections between the bottom ends of the columns and the base structure can be used to fix the columns in perpendicular orientation relative to the base structure in the working position thereof. Due to the connection of the tension members and the bladder to the columns or the tension members, the bladder will be expanded outwardly into the working position thereof together with deployment of the columns into the working position.

The bladder 16 according to the illustrated embodiment is a bag or envelope formed of flexible material which is fully enclosed about a hollow interior of the bladder that defines a storage volume for containing fluids therein. The bladder envelope includes (i) an upright perimeter boundary 50 defined by a cylindrical side wall which is joined to the columns and the circumferentially oriented tension members, (ii) a top boundary 52 defined by a circular flat top panel spanning the top side of the tank to enclose the bladder at the top side of the cylindrical side wall 50, and (iii) a bottom boundary 54 defined by a circular flat bottom panel spanning the bottom side of the tank to enclose the bladder at the bottom side of the cylindrical side wall 50. The bottom boundary 54 is typically engaged upon the upper supporting surface of the base structure.

The top boundary 52 is supported spaced above the bottom by various means. In some instances, air pressure within the internal volume of the bladder may be used to support the top panel. In other instances, the upper supports 30 may be supported under sufficient tension that the top panel of the bladder can be coupled to the upper supports and suspended therefrom. Yet further arrangements, rigid truss-like structures can be deployed to span across the top of the tank between columns at opposing sides of the tank from which the top panel of the bladder can be suspended.

According to a first embodiment shown in FIG. 1, the bladder defines a single storage volume having a single outer boundary defined by the perimeter boundary 50, the top boundary 52, and the bottom boundary 54. The boundary walls may be a single layer or multiple layers, or could in certain embodiments be a double layer construction with insulating material therebetween depending upon the operating environment.

The outer boundary may also be a composite construction of a flexible waterproof layer formed of a membrane of industrial fabric such as plastic or rubber sheet type material bonded to a tensile strength layer formed of flexible woven strands or other flexible strand or fibrous material embedded in the waterproof layer.

In a further embodiment shown in FIGS. 7 through 11, the bladder may include multiple compartments formed therein by one or more partition walls 56 which are formed of the same flexible sheet material as the outer boundary of the bladder so as to maintain separation of fluids in the two compartments separated by partition wall. In the illustrated embodiment, the multiple compartments include an inner compartment 58 which is generally cylindrical in shape and centrally located relative to the upright perimeter boundary 50 while being directly adjacent the bottom boundary 54, and an outer compartment 60 which surrounds a perimeter of the inner compartment and the topside of the inner compartment.

A level or pressure sensor acts to prevent overfill by detecting that the one or more compartments are full and in response thereto providing a control signal to shut off the pumps feeding the compartment(s).

In this instance the partition walls 56 include a cylindrical partition wall extending upward from the bottom boundary at a location spaced radially inward from the perimeter boundary 50 to define a radial gap between the outer boundary and the cylindrical partition about the full circumference of the inner compartment, and a top partition spanning across a top side of the inner compartment 58 at a location spaced below the top boundary 52 of the bladder to define an upper gap spanning vertically between the top panel of the inner compartment and the top boundary 52 of the bladder overall. The outer compartment thus occupies the radial gap and the upper gap in open communication with one another between the boundaries of the inner compartment and the outer boundaries of the bladder.

In this instance, a plurality of bridge members 62 may be provided in the form of flexible connecting cables or straps which are connected radially between the corresponding boundaries across the radial gap of the outer compartment 60 and which are also connected vertically between the corresponding boundaries across the upper gap of the outer compartment. The bridge members 62 serve to provide support to suspend the partition walls forming the boundaries of the inner compartment 58 relative to the outer boundaries of the bladder. The bridge members also serve to lift the top partition wall of the inner compartment to be folded inwardly upon itself as the bladder is collapsed into the transport position by following the folding of the top panel 52 of the bladder lifted by the lifting harness as illustrated in FIG. 9.

In alternative arrangements, air pressure may be used to maintain an inflated volume of the inner compartment as well as an inflated outer compartment in place of or in addition to the bridge members 62 noted above.

In yet further arrangements, the inner compartment may be further divided into a plurality of separate storage compartments by additional partition walls. The one or more compartments within the inner compartment 58 are typically used as a storage volume for containing stored fluids therein. Although the outer compartment may be similarly used for storage of additional fluids separate from the inner compartment, in preferred embodiments, the outer compartment provides an insulating function relative to the inner compartment.

When using air to provide structural support to the top panels of the compartments and to maintain the general shape of the compartments in the absence of stored fluids therein, a suitable blower 64 may be provided externally of the tank with suitable flow lines that enable air to be pumped into one or both of the compartments, typically through the top wall thereof. Suitable pressure sensors 66 can be operatively connected with the interior of each compartment for monitoring the pressure therein by a suitable controller 68 which controls operation of the blower 64 to independently maintain pressure within each of the compartments above prescribed lower limits thereof. The inner compartment may be maintained above a greater lower limit pressure than the outer compartment to better maintain the shape thereof, however in preferred embodiments the two compartments are maintained at similar pressures which remain above atmospheric pressure to maintain general inflation of the bladder.

To prevent pressure within the bladders from exceeding an upper limit, as the inner compartment is filled with a stored fluid for example, a suitable pressure relief vent 70 is operatively connected to respective valves 72 communicating through the top of each compartment for venting excess pressure to the surrounding atmosphere. The pressure relief arrangement is configured only for venting gas or air from the tanks and prevents the escape of liquid. The pressure relief arrangement is arranged to only open valves 72 if the respective compartment being monitored exceeds the prescribed upper pressure limit associated with the valve.

As noted above, the outer compartment is typically used as an insulating boundary surrounding the stored liquids within the inner compartment. In one embodiment, the outer compartment may comprise a static insulating fluid, for example air or a liquid.

In preferred embodiments, the fluid within the outer compartment is recirculated using a suitable recirculation pump 74 in operative communication with the fluid in the outer compartment to evenly distribute heat therein.

In yet a further arrangement, a heater 76 may be associated with the recirculation pump 74 to heat the fluid at a location externally of the tank for recirculation of the heated fluid back into the tank.

In a further arrangement, the recirculation pump 74 and the heater 76 are instead operatively connected to a suitable heat exchanger 78 having flow lines connected in a closed loop circuit with heat exchanger fluid contained therein which communicates between a first heat exchanger coil within the boundary gap of the outer compartment and a second heat exchanger coil heated by the heater 76 externally of the tank.

In yet a further arrangement, a boundary heater 80 may be provided to heat the outer boundary of the tank which in turn heats the fluid within the outer compartment to maintain heat within the fluid in the inner compartment. The boundary heater 80 may comprise electric resistance type heater for example which generates heat with heating elements incorporated into the boundary wall.

Regardless of the arrangement of the insulating boundary defined by the outer compartment, contents stored within the inner compartment may be directly heated in addition to or instead of the heating of the fluid within the outer compartment. In some instances, fluid within the inner compartment may be heated at the bottom boundary 54 of the tank where the tank is engaged upon the base structure.

In a first variant for heating the bottom boundary 54, a heated mat 82 may be provided independent of the base structure which spans the bottom side of the bladder between the bottom boundary 54 of the bladder thereabove and the upper supporting surface of the base structure therebelow. The heated mat may comprise an array of electrical resistance heating elements controlled by a suitable heat controller 84 or a plurality of fluid lines with heat exchanger fluid therein that is circulated between an external heat source and the heated mat 82 by the heat controller 84.

According to a second variant for heating the bottom boundary 54, the rigid panels of the base structure incorporate heating coils 86 directly therein which are operatively connected to an external heat controller 88 to provide heating either in the form of electrical supply to resistance type heating elements in the coils or to supply heated fluid through heat exchanger fluid conduits of the coils within the rigid panels.

Figure 11:
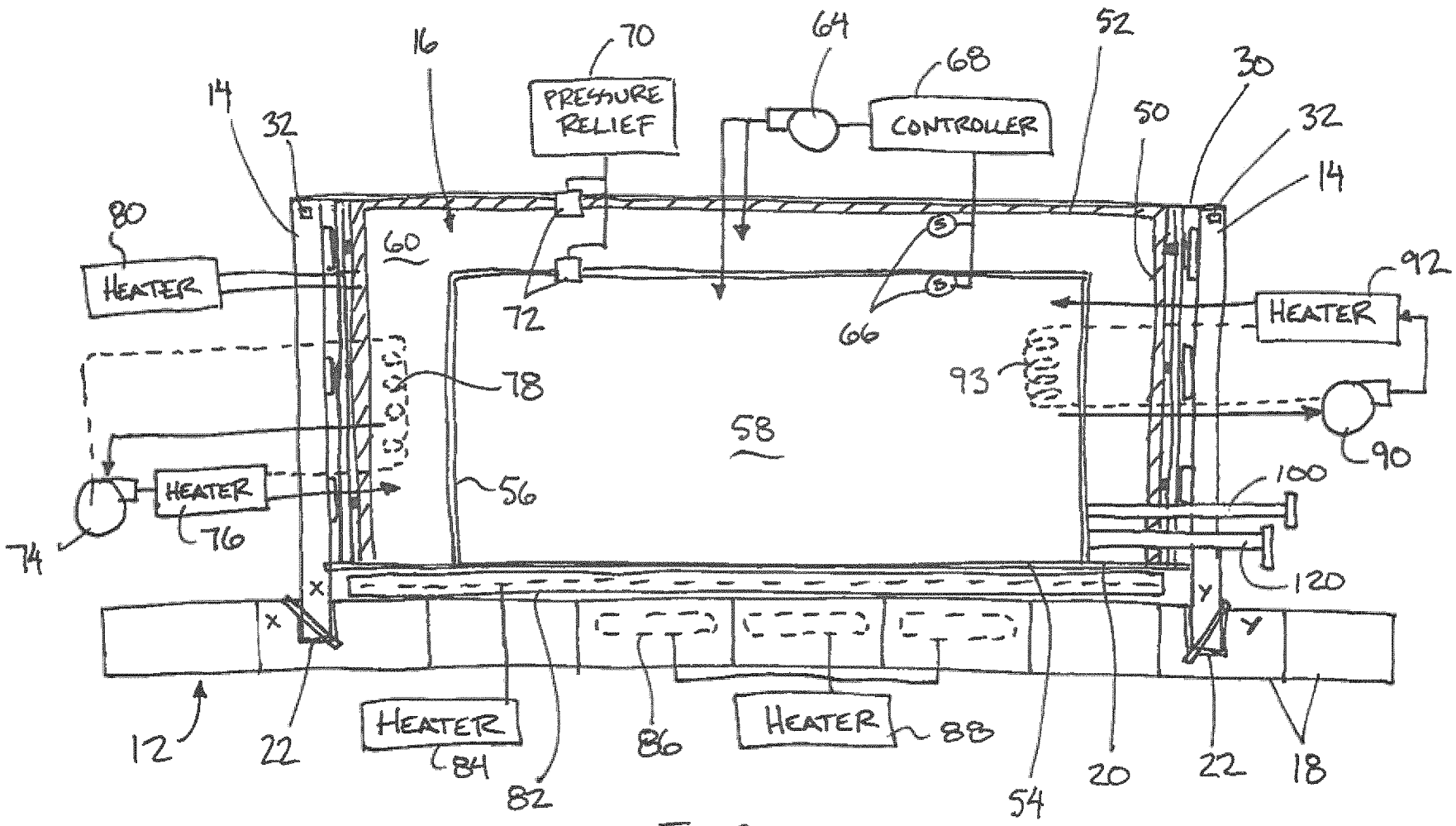
FIG. 11 is a schematic representation of the storage tank according to the second embodiment of FIG. 7 illustrating various optional heating arrangements.

In a further arrangement for prevention of freezing of fluids stored within the inner compartment, the fluid in the inner compartment may be simply recirculated using a suitable recirculation pump 90. In this instance fluid is pumped from the inner compartment and recirculated back into the inner compartment to evenly distribute heat and maintain fluidity throughout the stored fluid such as a liquid. The heater 92 shown in FIG. 11 is not required in this instance.

In a further arrangement, a suitable heater 92 is operatively connected to the recirculation pump 90 such that the recirculated fluid is heated prior to returning to the inner compartment of the tank. In yet a further arrangement, the recirculation pump 90 and the heater 92 may instead be used for heating a heat exchanger fluid which is circulated in a suitable heat exchanger 93. The heat exchanger has fluid lines connected in a closed loop circuit with heat exchanger fluid contained therein which communicates between a first heat exchanger coil within the interior volume of the inner compartment and a second heat exchanger coil heated by the external heater 92.

In all of the embodiments noted above, the heaters may comprise electrical heaters using electrical resistance type heating elements to produce heat. In other embodiments, each of the heaters may comprise a combustion heater in which a fuel is combusted to provide a heat source for heating the contents of the tank. In yet further embodiments, each of the heaters may be replaced by a heat exchanger in communication with waste heat from an adjacent process at the site of the tank so that the waste heat can be used to heat the contents of the tank.

In a preferred arrangement, the storage tank 10 is used on site for delivering fluid from the tank to an adjacent process such as a hydraulic fracturing arrangement. To accomplish this, a primary pump 94 and a secondary pump 96 are connected in parallel to one another so as to be redundant of one another. Each of the pumps includes an inlet valve 98 that selectively connects the pump to an outlet port 100 of the storage tank, and an outlet valve 102 that selectively connects the pump to a common intermediate line 104. The system further includes a primary inline heater 106 and a secondary inline heater 108 that are also connected in parallel to one another so as to be redundant of one another. More particularly each of the heaters includes one or a plurality of inlet valves 110 that selectively connects the heater to the common intermediate line 104 and an outlet valve 112 that selectively connects the heater to a common outlet line 114.

In this instance, when the valves associated with the primary pump are opened and the valves of the secondary pump are closed, flow is only directed through the primary pump while the secondary pump is isolated. Similarly, when the valves associated with the secondary pump are opened and the valves associated with the primary pump are closed, flow is only directed through the secondary pump while the primary pump is isolated.

In turn, when the valves associated with the primary heater are opened and the valves associated with the secondary heater are closed, flow is only directed through the primary heater while the secondary heater is isolated. Similarly, when the valves associated with the secondary heater are opened and the valves associated with the primary heater are closed, flow is only directed through the secondary heater while the primary heater is isolated.

Alternatively, both pumps and both heaters may be operational with all valves open to maximize the output flow from the tank. The redundant configuration of the pumps and heaters and enables continued operation of a heated flow of water from the tank even if one of the pumps or heaters should fail. A suitable controller 116 is operatively connected to each of the valves for operating the valves as well as being connected to the pumps and heaters for operating them as well. A suitable sensor 118 is connected to the common outlet line 114 that discharges fluid to the adjacent hydraulic fracturing process so that the controller can automatically monitor the operation of the pumps and heaters and automatically switch to operation of a different pump or heater in the event of a failure being detected such as a lower-than-expected pressure or flow rate or temperature.

The tank is provided with one or a plurality of inlet ports 120 in addition to the plurality of outlet port 100 noted above in which each of the ports comprises a suitable access pipe communicating through the outer boundary of the tank in the instance of a single compartment tank or communicating through the boundary walls of both the inner and outer compartments in the instance of a multi-compartment tank. In each instance the inlet and outlet ports 120 and 100 communicate with the stored fluids within the tank for discharging fluid from the tank or for filling the tank with stored fluids. Suitable valves are provided in series with the inlet and outlet ports externally of the bladder, along with connecting flanges on the ports for connection to auxiliary equipment as may be desired. Backflow valves may be applied to inlet and outlet ports 120 and 100.

In use, the tank is deployed by initially preparing the site for the tank by providing a suitable foundation upon which the base structure can be assembled. The rigid panels of the base structure are delivered to the site and interconnected with one another to form a uniform rigid structure with an upper supporting surface upon which the remainder of the tank can be supported. In some embodiments the base structure may further comprise flexible tension members spanning the bottom side of the tank, or the base structure itself may be comprised only of flexible tension members. In this instance, the shape of the bladder, the flexible base structure, and the circumferentially oriented tension members connected between the spaced apart columns in the working position may be sufficient to position the columns relative to one another and maintain the general shape and structure of the tank.

In either instance, once the base structure has been laid on the foundation, the bundled columns in the transport position are suspended from a crane so that the strap members about the bundle can be released. The columns can be spread apart from one another from the transport position to the working position by various means. In the instance of a flexible base structure for example, the bladder may be inflated with air under pressure to expand the bladder and spread the columns outwardly from one another. When a rigid base structure is provided, suitable winch assemblies may be anchored onto the base structure and connected to respective ones of the columns for pulling the columns outwardly from the transport position to their designated mounting locations on the rigid panels of the base structure respectively. Once the columns have been coupled to their designated mounting locations and raised into a vertical orientation perpendicular to the base structure, the columns are fixed in orientation. The circumferentially oriented tension members are automatically supported under tension in the circumferential direction by the columns being displaced into the working position. The bladder will typically follow the displacement of the columns into the working position and accordingly be displaced into the working position thereof. Initially filling the bladder with pressurized air can assist in supporting the top panels at the upper boundary of the inner and outer compartments or other supporting structures under tension across the top of the tank may be employed as described above. Fluid is loaded into the tank using the inlet port 120 with the air under pressure within the tank being proportionally removed as fluid such as liquid fills the tank. The outward pressure of inflation of the bladder or the outward pressure of stored fluids such as liquids within the bladder applies and even pressure radially outward to all of the columns to maintain the cylindrical shape of the tank. Once the tank is been assembled, additional heating equipment is connected and operated as desired.

In summary, the unit may be made of material as follows: (a) a base such as rig mats with mounting hardware to secure the columns and knee braces, (b) exterior bracing columns made of materials such as steel tubing, H-Beam, etc with knee bracing which connects to the steel column and also to the base, (c) Guy wires which support the upper portions of the column down to the base, (d) connection points for securing the cable rigging for mobilization and demobilization (connection could be either to the columns or to the flexible support material), (e) a crane rigging system, (f) optional strapping to secure the columns together for transport, which could be made of any fastening equipment such as strapping and fasteners to band all the columns together for shipping, (g) flexible supporting material which holds the columns at defined intervals while providing horizontal support, such as cargo net material, (h) horizontal bracing made of flexible structural material such as steel cable, which may or may not be integral to the flexible supporting material which holds the columns at the defined spaces, (i) an interior bladder which may or may not be compartmentalized, (j) optional flexible upper structural members which go over top of the fluid bladder which prevent the walls from succumbing to external collapsing, depending on the size and structural support of the whole system, for example cargo netting, and (k) optional flexible lower structural members similar to the upper structural members but underneath the bladder.

The tank may also include optional mechanical equipment, for example to assist in preventing freezing, including: (a) pumping or blower equipment, (b) Inlets/outlets and pressure relieving valves, and (c) Optional internal lines which could act as "heating coils" or aeration lines. The tank may further optionally include external lines for example to convey glycol.

The unit collapses for shipment or storage, and can be bundled together and fastened so that it can be loaded horizontally on a trailer.

The base structure is used for securing the fluid storage system in the working position. The base may have an identification system to number the layout so that the connection points are laid down at the right locations. The columns could be placed into female receiving ports, together with connection points wherein the knee braces, guy wires, and other structural supports would connect. Such pre-configured connection points could be inverted hook, fasteners, clamps etc. The base may be configured of rig mats with the custom connectors. A numbering or lettering system to identify the column and its corresponding place to mount on the base assists assembly.

Rigging is provided for installation or demobilization. The columns or the flexible material would contain connection points to attach the rigging. The rigging system is a series of connected harnesses such that it would have many rigging cables or straps and could have a spreader bar too. There are a number of ways that one could configure it. Essentially the rigging straps would hang quite far down from the point which is connected to the crane, so that the crane operator would bring the connection on one side of an erected unit, and operators would take corresponding rigging straps and manually walk around the unit to connect to their connection points, then the operators would remove the column connections from the base (ie: knee braces/guy wires) so that once the unit is disconnected from the base for demobilization, then the crane would lift it up, the operators would attach the securing straps or cables, and then the crane would put it down on the ground or trailer in a horizontal position.

When installing the storage unit, the crane would lift the unit from the horizontal position with all the attached rigging in the rigging manifold. Then once the whole unit is secured to the base with the columns/knee braces/guy wires, the operators would walk around the unit and detach all the rigging straps, at which time the crane would then pull up the rigging manifold and remove it from around the water storage.

The interior bladder could be attached at intervals inside the exterior flexible support material, such that when it is collapsed, it continues to stay in the right position both vertically and circumferentially so it is ideally positioned for the next time it is erected.

The bladder has port(s) and discharge port(s), which could include backflow valves. The bladder optionally contains compartments, such as an exterior compartment which could be used to contain an insulating fluid, such as air or insulating liquid, or material to assist avoiding freezing of the liquids in the main compartment. If compartmentalized, the additional compartments could additionally be used for liquids if desired. The additional compartments could take other shapes than what is represented in the illustrated embodiment.

The operator could use blowers to circulate air through the system to aerate the liquid to assist in avoiding freezing. In doing so, it would require the use of normal valving such as backflow valves to ensure that fluid could not come back through the aeration lines.

A circulation pump could just be used to keep the liquid circulating in and out of the storage system constantly to prevent freezing.

The system could have heat coil lines in it—such as appropriately protected electrical lines or perhaps glycol lines to be used to heat the liquid.

For filling and emptying the fluid storage, port(s) would come into the bladder at designated locations, and out through the flexible walls at designed locations. The fluid such as liquid would be pumped into the storage, and would be pumped out. When emptying the storage, it may be preferable to inflate the compartments to purge out any residual fluid such as liquid so it would not freeze once disassembled. Alternatively, it could also be emptied by pumping to apply a suction or vacuum pressure to the contents of the tank.

When heating under the water storage (over the rig mats), this may optionally be done with a sewn blanket with hydronic type lines for use with glycol, or with electrical heat pads. One could even have a base built with integral heating as described above which could be placed over the rig mats or be incorporated into the rig mats.

It is also possible to run heating lines into the main compartment, or in the insulation outer compartment (or both), or that they could even be affixed to the exterior walls which may happen in cases where there is only a single bladder.

Figure 10:
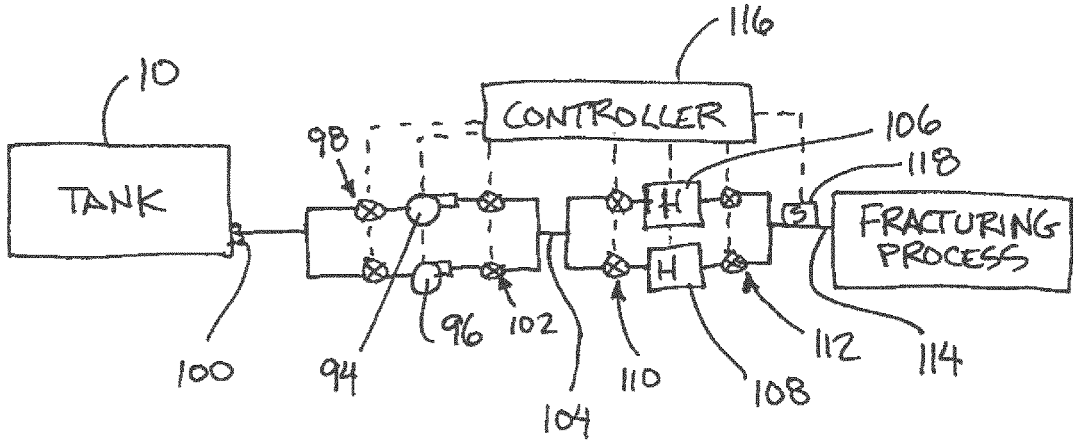
FIG. 10 is a schematically representation of the storage tank according to either embodiment in operative connection to a hydraulic fracturing process using redundant pumps and redundant inline heaters for pumping and heating water from the storage tank to the hydraulic fracturing process.

The recirculation pumps can also include redundant primary and second pumps together with automatic switches to run the second (or additional) units in the case that one stops operating as described in relation to the discharge pumps shown in FIG. 10.

When using air pumped into the compartments, an operator can prefill the main and/or auxiliary compartments (or single compartments in the case of single compartment bladders), and the air would be filled to low pressure, but when fluid for example liquid is introduced, the bladder would then pressurize a bit. The blowers are preferably mounted and set to automatically run. Use of relief valves could also be incorporated to permit release of over-pressured air (but not liquids) as described above.

The upright columns arranged to be coupled to the base structure and to extend upwardly therefrom may be partly round and wider than just an H-Beam or tubing.

In other embodiments, there may be two or more compartments in the bladder.

It will be appreciated that other types of mounting hardware, for example fasteners, may be used to couple the frame columns to the base structure than that which is shown and described in detail herein.

In other embodiments, the side wall defining the upper perimeter boundary of the bladder envelope may have other shapes aside from being cylindrical as in the illustrated embodiment(s).

In other embodiments, the horizontal bracing made of flexible structural material may be cargo net strapping or sling material instead of steel cable.

In other embodiments, the bladder may be removable from the frame so as to be detached therefrom before collapsing from the working position to the transport position.

In other embodiments, the lifting harness may comprise a pair of crane hook attachments and a spreader bar between respective ones of the pair of crane hook attachments.

In other embodiments, the flexible tension members may comprise strapping material such as cargo netting or slings.

In other embodiments, the bladder may be pressurized with a different gas than air.

In other embodiments, contents of the inner or single compartment may also be recirculated.

In other embodiments, the heater may be a combustion heater.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A fluid storage tank comprising:

a base structure arranged to be supported on a supporting foundation at a bottom of the tank;

a plurality of upright columns arranged to be releasably coupled to the base structure and to extend upwardly from the base structure at circumferentially spaced apart positions about a perimeter of the tank in a working position of the columns;

a flexible bladder arranged to be coupled to the upright columns, the flexible bladder defining (i) a bottom boundary spanning the bottom of the tank, (ii) an upright perimeter boundary extending upwardly from the bottom boundary, and (iii) a top boundary spanning a top of the tank such that a hollow interior of the tank suitable is fully enclosed by the bottom boundary, the upright perimeter boundary and the top boundary for containing a fluid within the tank; and a flexible structural members connected between the upright columns under tension in the working position; and wherein upon release from the base structure, the upright columns are inwardly collapsible from the working position to a transport position by flexing of the structural members which remain interconnected between the upright columns, the columns being bundled alongside one another in the transport position.

2. The storage tank according to claim 1 wherein the base structure is arranged to extend below the flexible bladder under tension between diametrically opposing ones of the upright columns.

3. The storage tank according to claim 1 wherein the bladder is arranged to remain coupled to the upright columns as the columns are collapsed from the working position to the transport position.

4. The storage tank according to claim 1 wherein each of the columns extends a full height of the storage tank and remains fixed in length such that the columns continue to span the full height of the storage tank as the columns are displaced between the working position and the transport position.

5. The storage tank according to claim 1 further comprising strapping members arranged to extend under tension circumferentially about the upright columns bundled in the transport position such that the columns are supported in fixed relation to one another by the strapping members in the transport position.

6. The storage tank according to claim 1 wherein at least some of the columns include rigging mounts formed thereon so as to be arranged to secure the columns to a crane lift cable.

7. The storage tank according to claim 1 wherein the flexible structural members include a plurality of tension members coupled between the upright columns in a circumferential direction of the tank in the working position.

8. The storage tank according to claim 7 wherein the tension members include flexible cables extending about a full circumference of the tank in the working position.

9. The storage tank according to claim 1 further comprising the tension members include structural straps extending about a full circumference of the tank in the working position.

10. The storage tank according to claim 1 further comprising a plurality of upper supports connected under tension between the upright columns to span over the top boundary of the flexible bladder in the working position above the bladder.

11. The storage tank according to claim 1 wherein the base structure includes a plurality of flexible members extending diametrically under tension across the bottom of the tank between respective ones of the upright columns below the bladder.

12. The storage tank according to claim 1 wherein the base structure includes a plurality of rigid panels releasably connected with one another to form a floor supporting the upright columns and the flexible bladder thereon.

13. The storage tank according to claim 12 wherein the rigid panels include sockets supported thereon and arranged to receive respective ones of the columns therein in the working position.

14. The storage tank according to claim 1 wherein the columns are releasably attached to the base structure and wherein the base structure and the columns include corresponding identification markings formed thereon.

15. The storage tank according to claim 1 further comprising a plurality of brace members releasably connected between an exterior of the columns and the base structure at a location spaced outwardly from the bladder in the working position.

16. The storage tank according to claim 1 wherein the bladder is arranged to be folded inwardly upon itself together with movement of the columns inwardly towards one another from the working position to the transport position thereof in which the columns continue to span the full height of the storage tank as the columns are displaced between the working position and the transport position.

17. The storage tank according to claim 1 wherein the hollow interior of the bladder is arranged to be pressurized.

18. The storage tank according to claim 17 further comprising a blower operatively connected to the bladder so as to be arranged to inflate the bladder and drive expansion of the columns from the transport position to the working position.

19. The storage tank according to claim 17 further comprising a blower operatively connected to the bladder and a controller arranged to monitor air pressure within the bladder and activate the blower to maintain pressure above a prescribed lower limit.

20. The storage tank according to claim 17 further comprising a relief valve arranged to relieve air from the bladder when air pressure within the bladder exceeds a prescribed upper limit.

21. The storage tank according to claim 1 wherein the outer boundary of the bladder is insulated.

22. The storage tank according to claim 1 wherein the hollow interior of the bladder comprises a plurality of compartments separated by flexible partition walls within the outer boundary of the bladder.

23. The storage tank according to claim 22 further comprising a plurality of flexible support members connected between the partition walls and the outer boundary of the tank to support the partition walls relative to the outer boundary of the bladder.

24. The storage tank according to claim 22 wherein the compartments include an inner compartment and an outer compartment surrounding at least one of a top and a perimeter of the inner compartment.

25. The storage tank according to claim 24 wherein the outer compartment is filled with a heat insulating fluid.

26. The storage tank according to claim 24 wherein the outer compartment is filled with air.

27. The storage tank according to claim 24 wherein the outer compartment is filled with a heated fluid.

28. The storage tank according to claim 25 wherein contents of the outer compartment are recirculated using a blower or a pump.

29. The storage tank according to claim 1 further comprising a heater for heating contents of the bladder, wherein the heater is provided at the upright perimeter boundary and the bottom boundary of the bladder for heating stored liquid in the bladder and wherein the base structure includes a plurality of rigid panels releasably connected with one another to form a floor supporting the upright columns and the flexible bladder thereon and wherein the heater is incorporated into the rigid panels.

30. The storage tank according to claim 1 further comprising a recirculating pump in operative connection with the bladder so as to be arranged to recirculate stored fluid in the bladder.

31. The storage tank according to claim 1 further comprising a primary pump arranged to deliver stored fluid from the bladder, a secondary pump operatively connected in redundant relationship to the primary pump, and a controller arranged to automatically activate the secondary pump in response to detection of a fault of the primary pump.

32. The storage tank according to claim 1 further comprising a pump arranged to deliver stored fluid from the bladder and an inline heater connected inline with the pump so as to be arranged to heat the stored fluid as the stored fluid is delivered from the bladder.

33. The storage tank according to claim 32 further comprising a secondary heater operatively connected in redundant relationship to said inline heater, and a controller arranged to automatically activate the secondary heater in response to detection of a fault of the inline heater.

34. The storage tank according to claim 1 wherein the flexible structural members include at least one of (i) a plurality of upper supports connected between the upright columns to extend under tension over the top boundary of the flexible bladder above the bladder in the working position, and (ii) a plurality of tension members coupled between the upright columns in a circumferential direction of the tank in the working position.

35. The storage tank according to claim 1 wherein the flexible bladder is arranged to remain coupled to at least one of the flexible structural members and the upright columns as the columns are collapsed from the working position to the transport position.

36. A fluid storage tank comprising:

a base structure arranged to be supported on a supporting foundation at a bottom of the tank;

a plurality of upright columns arranged to be coupled to the base structure and to extend upwardly from the base structure at circumferentially spaced apart positions about a perimeter of the tank in a working position of the columns, the upright columns being collapsible from the working position to a transport position in which the columns are arranged to be bundled alongside one another in the transport position;

a flexible bladder arranged to be coupled to the upright columns, the flexible bladder defining (i) a bottom boundary separate from the base structure and (ii) an upright perimeter boundary of the tank suitable for containing a fluid within the tank;

wherein the base structure is arranged to extend below the flexible bladder under tension between diametrically opposing ones of the upright columns;

wherein at least some of the columns includes rigging mounts formed thereon so as to be arranged to secure the columns to a crane lift cable; and a lifting harness comprising (i) a central lifting attachment for connection to the crane lift cable and (ii) a plurality of intermediate cables for connection between the central lifting attachment and the riggings mounts of the columns respectively.

37. A fluid storage tank comprising:

a base structure arranged to be supported on a supporting foundation at a bottom of the tank;

a plurality of upright columns arranged to be coupled to the base structure and to extend upwardly from the base structure at circumferentially spaced apart positions about a perimeter of the tank in a working position of the columns, the upright columns being collapsible from the working position to a transport position in which the columns are arranged to be bundled alongside one another in the transport position;

a flexible bladder arranged to be coupled to the upright columns, the flexible bladder defining (i) a bottom boundary separate from the base structure and (ii) an upright perimeter boundary of the tank suitable for containing a fluid within the tank;

wherein the base structure is arranged to extend below the flexible bladder under tension between diametrically opposing ones of the upright columns;

wherein the bladder further defines a top boundary, wherein a hollow interior of the bladder is fully enclosed by the bottom boundary, the upright perimeter boundary and the top boundary of the bladder, the storage tank further comprising a plurality of upper supports connected under tension between the upright columns to span over the top boundary of the flexible bladder in the working position above the bladder; and wherein the top boundary of the flexible bladder is connected to and suspended from the upper supports and wherein the upper supports are flexible and remain coupled to the columns so as to be collapsible together with the columns between the working position and the transport position.

38. A fluid storage tank comprising:

a base structure arranged to be supported on a supporting foundation at a bottom of the tank;

a plurality of upright columns arranged to be coupled to the base structure and to extend upwardly from the base structure at circumferentially spaced apart positions about a perimeter of the tank in a working position of the columns, the upright columns being collapsible from the working position to a transport position in which the columns are arranged to be bundled alongside one another in the transport position;

a flexible bladder arranged to be coupled to the upright columns, the flexible bladder defining (i) a bottom boundary separate from the base structure and (ii) an upright perimeter boundary of the tank suitable for containing a fluid within the tank; and a plurality of guy wires releasably connected between the columns and the base structure at a location spaced outwardly from the bladder in the working position;

wherein the base structure is arranged to extend below the flexible bladder under tension between diametrically opposing ones of the upright columns; and wherein the bladder further defines a top boundary, wherein a hollow interior of the bladder is fully enclosed by the bottom boundary, the upright perimeter boundary and the top boundary of the bladder, the storage tank further comprising a plurality of upper supports connected under tension between the upright columns to span over the top boundary of the flexible bladder in the working position above the bladder.

39. The storage tank according to claim 38 further comprising a plurality of tension members coupled between the upright columns in a circumferential direction of the tank in the working position, wherein the bladder is connected to the tension members.

40. A fluid storage tank comprising:

The storage tank according to claim 1 further a base structure arranged to be supported on a supporting foundation at a bottom of the tank;

a plurality of upright columns arranged to be coupled to the base structure and to extend upwardly from the base structure at circumferentially spaced apart positions about a perimeter of the tank in a working position of the columns, the upright columns being collapsible from the working position to a transport position in which the columns are arranged to be bundled alongside one another in the transport position;

a flexible bladder arranged to be coupled to the upright columns, the flexible bladder defining (i) a bottom boundary separate from the base structure and (ii) an upright perimeter boundary of the tank suitable for containing a fluid within the tank; and a heater for heating contents of the bladder;

wherein the base structure is arranged to extend below the flexible bladder under tension between diametrically opposing ones of the upright columns; and wherein the bladder comprises an inner compartment receiving stored fluid therein and an outer compartment surrounding a top and a perimeter of the inner compartment which receives an insulating fluid therein, the heater being arranged to heat the insulating fluid in the outer compartment.

* * * * *